US005502553A

United States Patent [19]

Masuda et al.

[11] Patent Number: 5,502,553

[45] Date of Patent: Mar. 26, 1996

[54] DEVELOPING DEVICE

[75] Inventors: Toshiki Masuda, Okazaki; Akio Kimura, Toyokawa, both of Japan

[73] Assignee: Minolta Co., Ltd., Osaka, Japan

[21] Appl. No.: 394,168

[22] Filed: Feb. 22, 1995

[30] Foreign Application Priority Data

Feb. 24, 1994 [JP] Japan ..... 6-026562

[51] Int. Cl.[6] ..... G03G 15/06

[52] U.S. Cl. ..... 355/260; 141/346; 141/367; 222/DIG. 1; 355/245

[58] Field of Search ..... 355/260, 245; 222/DIG. 1, 172, 169, 454, 457; 141/346, 351, 367, 364

[56] References Cited

U.S. PATENT DOCUMENTS

| | | | |
|---|---|---|---|
| 5,049,941 | 9/1991 | Manno et al. | 355/260 |
| 5,250,749 | 10/1993 | Aimoto | 355/245 X |

FOREIGN PATENT DOCUMENTS

| | | | |
|---|---|---|---|
| 0604999 | 7/1994 | European Pat. Off. | 355/260 |
| 63-214765 | 9/1988 | Japan | 355/260 |
| 03-071172 | 3/1991 | Japan | 355/260 |
| 4-1681 | 1/1992 | Japan . | |
| 4-477 | 1/1992 | Japan . | |
| 04-141681 | 5/1992 | Japan | 355/260 |
| 4-333078 | 11/1992 | Japan . | |
| 05-150644 | 6/1993 | Japan | 355/260 |
| 06-102758 | 4/1994 | Japan | 355/260 |

*Primary Examiner*—Mathew S. Smith
*Attorney, Agent, or Firm*—Burns, Doane, Swecker & Mathis

[57] ABSTRACT

A developing device using dual-component developer which is detachably attachable a first cartridge accommodating toner or a second cartridge accommodating starter incorporating at least carrier. The developing device has a developing section which develops an electrostatic latent image on a photosensitive member, a coupling which detachably holds a first cartridge or a second cartridge and having a first aperture corresponding to a replenishment aperture of the first cartridge as well as a second aperture corresponding to a replenishment aperture of the second cartridge, toner buffer which supplies toner from the first cartridge to the developing section by predetermined amounts when the first cartridge is attached to the coupling, and a replenishment path provided between the developing section and the coupling for supplying starter from the second cartridge directly to the developing section when the second cartridge is attached to the coupling.

15 Claims, 4 Drawing Sheets

DEVELOPING DEVICE

BACKGROUND OF THE INVENTION

1. Field of the Invention

The present invention relates to a developing device for developing electrostatic latent images formed on a photosensitive member in image forming apparatus of copiers, printers and the like.

2. Description of the Related Art

Among conventional developing devices used in copiers and the like, are types wherein toner accommodated in a hopper is supplied to a developing tank via a toner metering section (hereinafter referred to as "toner buffer"). Developing devices of the aforesaid type are constructed such that hopper 200 and developing device 300 are connected via buffer section 400, as shown in FIG. 1. In hopper 200, coupling 202 connected to screw cartridge 201 is rotatably driven by screw cartridge drive motor 203. Toner is supplied from the rotatably driven screw cartridge 201 to buffer section 400 via aperture 204 provided in screw cartridge 201. Toner supplied to buffer section 400 is transported by transport screw 402 driven by buffer section drive motor 401 so as to be supplied to developing device 300.

Toner supplied to developing device 300 is mixed with a carrier while being transported into the interior of said developing device 300, and develops an electrostatic latent image formed on the surface of photosensitive member 310. Drive control of screw cartridge drive motor 203 and buffer section drive motor 401 is accomplished in accordance with the detection of the amount of toner adhering to the surface of photosensitive member 310 via reflecting-type photosensor 311, and detection of the amount of toner within buffer section 400 via piezoelectric sensor 403.

The previously described developing device has certain disadvantages insofar as when a dual-component developer comprising a toner and a carrier is used. That is, when developer (hereinafter referred to as "starter") incorporating a carrier is supplied from a hopper to the developing section when the developer is first used or when carrier is replaced due to carrier depletion, developer must be supplied once to a buffer section, thereby prolonging the time for supplying the starter to the interior of the developing device.

OBJECTS AND SUMMARY

A main object of the present invention is to provide a developing device which allows a user to simply accomplish replenishment of starter to the developing device.

Another object of the invention is to provide a developing device capable of rapid replenishment of starter to the developing device.

These and other objects of the present invention are achieved by providing a developing device which is detachably installable a first cartridge accommodating toner or a second cartridge accommodating starter incorporating at least carrier, the developing device comprising a developing section which develops an electrostatic latent image formed on a photosensitive member, toner buffer which supplies toner therethrough from the first cartridge to said developing section by predetermined amounts when the first cartridge is attached to the developing device, and a replenishment path which is provided separately from said toner buffer and supplies developer therethrough from the second cartridge directly to said developing section, when the second cartridge is attached to the developing device.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

The preferred embodiments of the present invention are described hereinafter with reference to the accompanying drawings.

Figure 1:
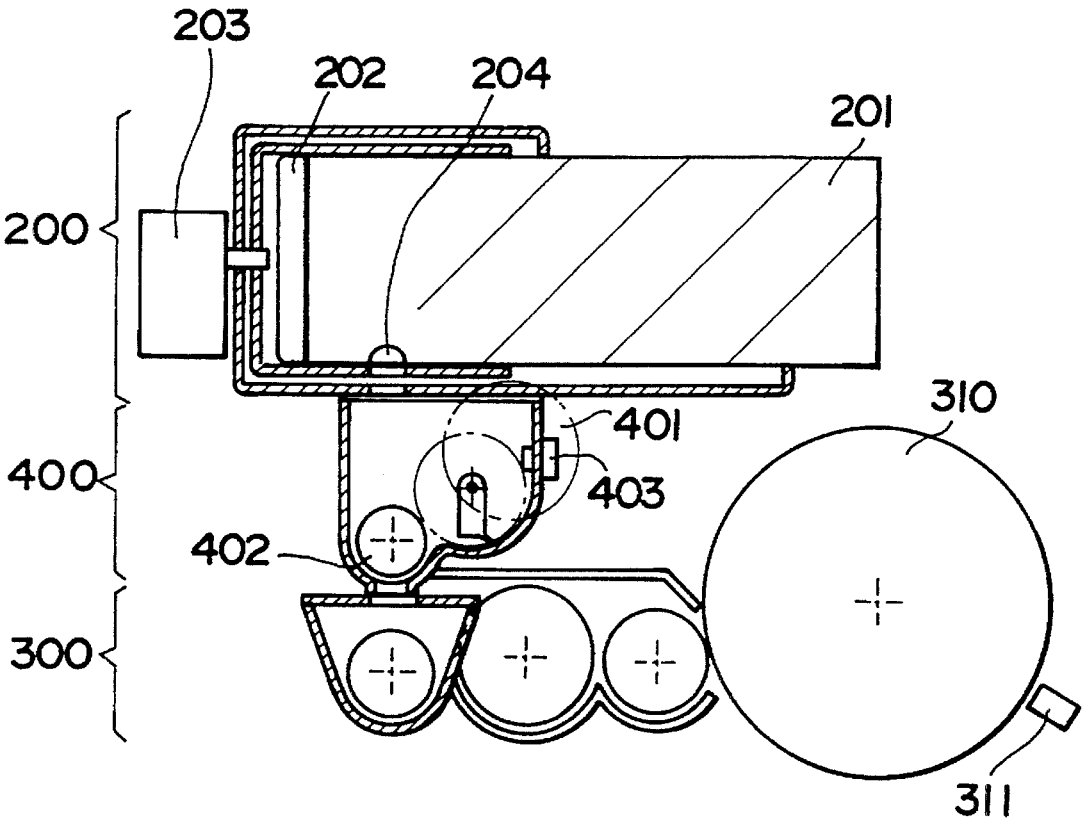
FIG. 1 Prior art
FIG. 1 is a section view showing the construction of a conventional developing device.
Figure 2:
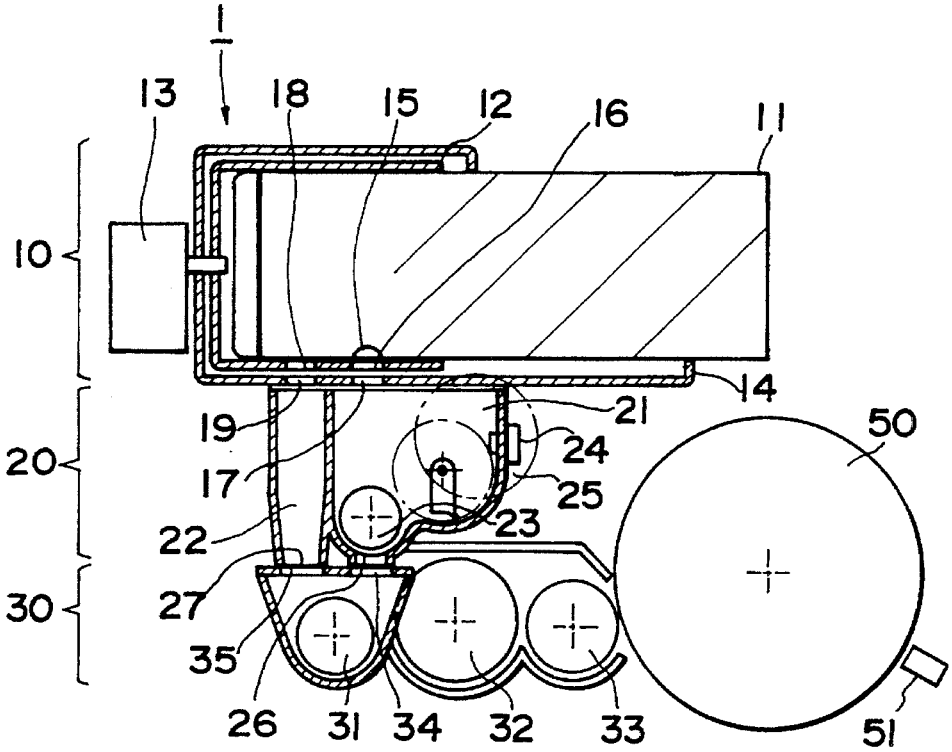
FIG. 2 is a section view showing a first embodiment of the developing device of the present invention.

FIG. 2 is a section view showing a first embodiment of the developing device of the present invention.

Developing device 1 is provided with hopper section 10 connected to developing section 30 via buffer section 20. Hopper section 10 comprises coupling 12 for supporting screw cartridge 11 so as to be removably installable, drive motor 13 connected to coupling 12 for rotatably driving screw cartridge 11 together with said coupling 12, and holder 14 for accommodating coupling 12 and screw cartridge 11.

Screw cartridge 11 is provided with toner replenishment aperture 15 on the peripheral surface thereof. Coupling 12 and holder 14 are provided with toner replenishment apertures 16 and 17, respectively, at positions corresponding to said aperture 15 provided on screw cartridge 11. Furthermore, starter replenishment apertures 18 and 19 are aligned with the aforesaid apertures 16 and 17 at respectively distinct positions of coupling 12 and holder 14 in the rotational direction. Screw cartridge 11 is fixedly attached to coupling 12 via chucking portion (not illustrated) provided on said coupling 12. Coupling 12, which supports screw cartridge 11, is rotatably driven by a drive motor 13 in accordance with the detection results of piezoelectric sensor 24 and reflecting-type photosensor 51 which are described later. Screw thread-like protrusions are provided on the interior wall surface of screw cartridge 11 which rotates together with coupling 12, such that toner accommodated in screw cartridge 11 is transported via said screw thread-like protrusions in a leftward direction in the drawing in conjunction with the rotation of said screw cartridge 11.

Buffer section 20 is provided at the bottom of hopper 10. Buffer section 20 comprises toner buffer 21 provided at the bottom of toner replenishment aperture 17 on holder 14, and replenishment path 22 for replenishing developer provided at the bottom of starter replenishment aperture 19 on holder 14. Toner buffer 21 receives toner supplied from aperture 17 of holder 14, and is provided with transport screw 23 for mixing and transporting said toner, and piezoelectric sensor 24 for detecting the amount of toner within toner buffer 21. Aperture 26 is provided at the lowermost region of toner buffer 21 to supply toner to developing section 30. On the other hand, aperture 27 is provided at the lowermost region of replenishment path 22 to supply starter to developing section 30.

Developing section 30 is provided below buffer section 20. Developing section 30 is provided with aperture 34 for receiving toner supplied from the aforesaid aperture 26, and aperture 35 for receiving developer supplied from the aforesaid aperture 27. Developing section 30 is further provided with transport screw 31 for circulating toner and developer supplied from the aforesaid apertures 34 and 35, mixing blade 32 for mixing and transporting toner and developer transported by said transport screw 31, and developing roller 33.

Toner accommodated in screw cartridge 11 is transported in a leftward direction in the drawings in conjunction with the rotation of said screw cartridge 11, and drops from aperture to toner buffer 21 via apertures 16 and 17 when said aperture 16 of coupling 12 is aligned with said aperture 17 of holder 14. Toner which drops into toner buffer 21 is transported by transport screw 23 and drops from aperture 26 into developing section 30 via aperture 34. Toner delivered into developing section 30 is circulated with developer within said developing section 30 via transport screw 31, mixed via mixing blades 32, and develops an electrostatic latent image formed on the surface of photosensitive member 20 by developing sleeve 33. Toner replenishment from screw cartridge 11 to toner buffer 21 is controlled by actuating drive motor 13 when a reduction in the amount of toner within toner buffer 21 is detected by piezoelectric sensor 24 provided in said toner buffer 21, and toner replenishment from toner buffer 21 to developing section 30 is accomplished in accordance with a detection value of the density of the toner image formed on the surface of photosensitive member 50 which is detected by reflecting-type photosensor 51 provided in the vicinity of said photosensitive member 50.

Figure 3:
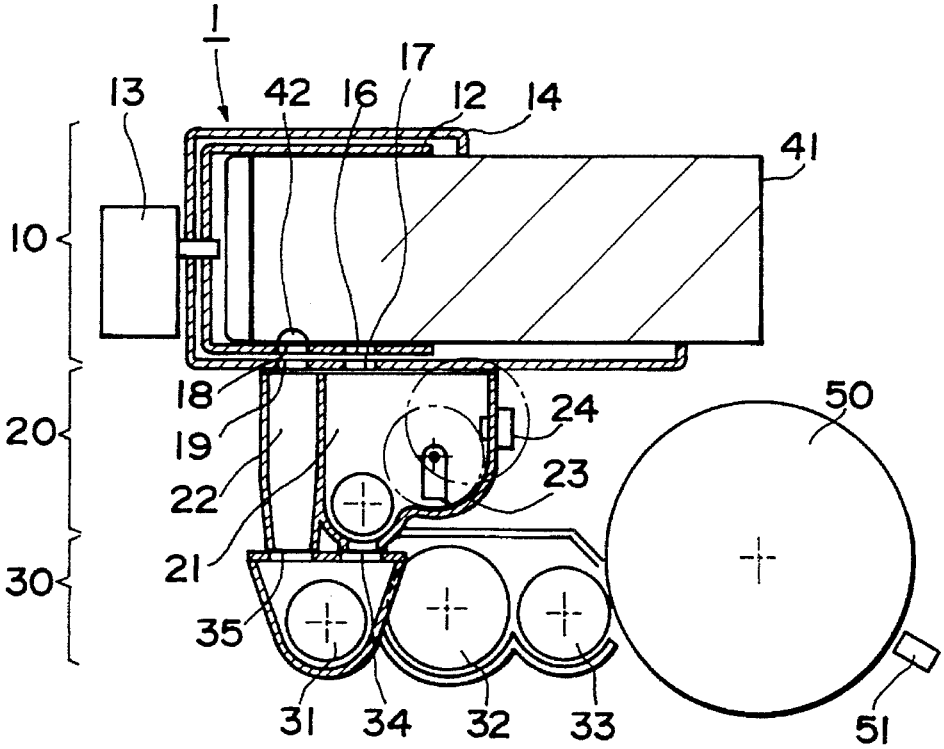
FIG. 3 is a section view showing a first embodiment of the developing device of the present invention.

FIG. 3 is a section view illustrating a first embodiment of the developing device of the present invention when starter is replenished.

In a departure from toner replenishment shown in FIG. 2, during starter replenishment, screw cartridge 41 which accommodates the starter is loaded in coupling 12 instead of the previously described screw cartridge 11. Screw cartridge 41 is provided with aperture 42 disposed at a position corresponding to starter replenishment aperture 18 provided on coupling 12, and starter replenishment aperture 19 provided on holder 14. Starter accommodated in screw cartridge 41 is directly supplied from aperture 42 to developing section 30 through replenishment path 22 via apertures 18 and 19 without using toner buffer 21 to the degree that aperture 18 of coupling 12 is aligned with aperture 19 of holder 14 in accordance with the rotation of cartridge 41.

Figure 4:
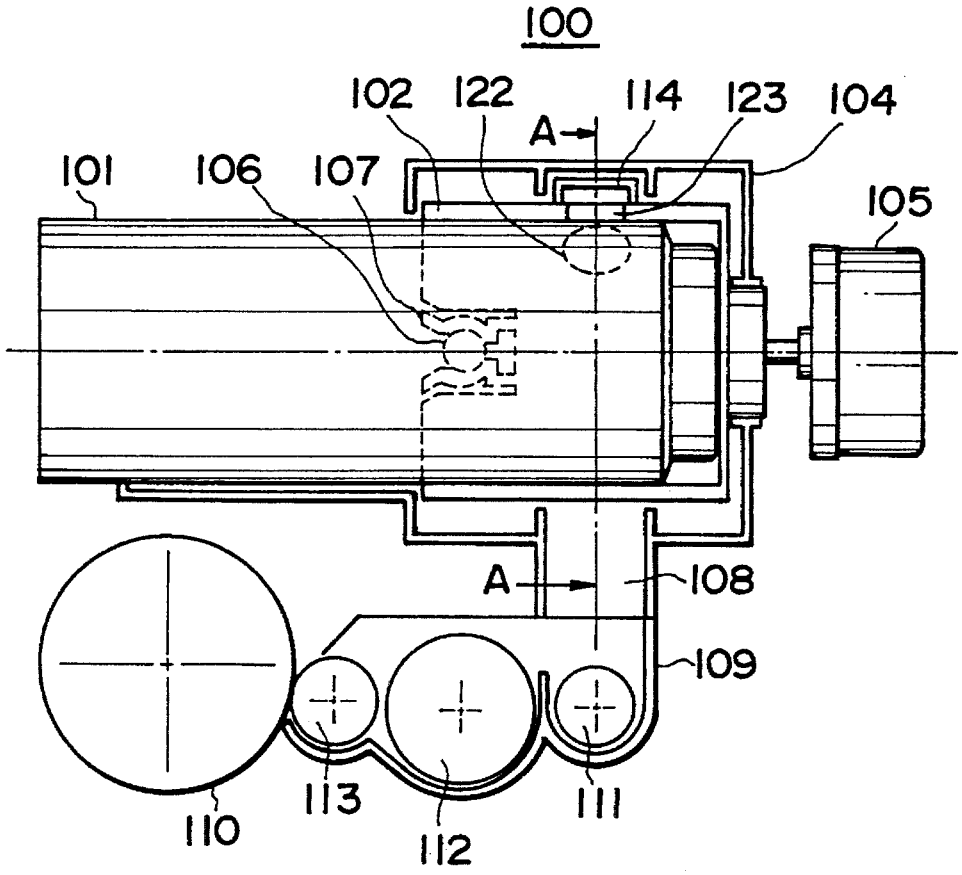
FIG. 4 is a section view showing a second embodiment of the developing device of the present invention.

FIG. 4 is a section view showing a second embodiment of the developing device of the present invention.

Although the aforesaid embodiment has been described by way of example wherein a toner replenishment aperture and starter replenishment aperture are provided at different positions in the axial direction of the screw cartridge, in the second embodiment, an example is described wherein said apertures are disposed at different positions in the circumferential direction of the screw cartridge.

Figure 7:
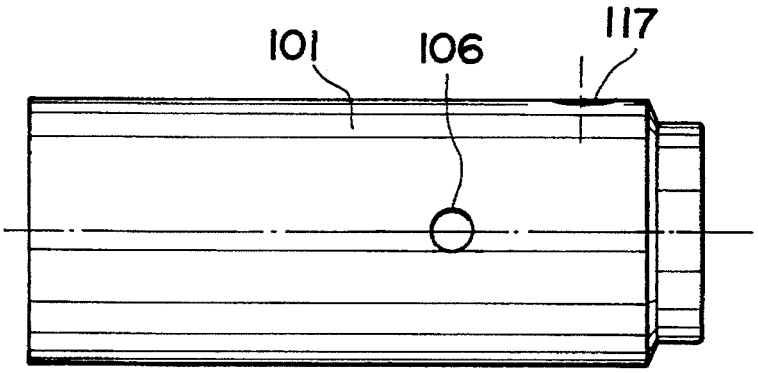
FIG. 7 is a side view showing the screw cartridge used in the second embodiment.

Developing device 100 shown in FIG. 4 shows the state wherein screw cartridge 101 of FIG. 7 which accommodates toner is installed. Screw cartridge 101 is provided with protrusion 106 which engages chucking portion 107 provided on coupling 102 described later, and is further provided with toner replenishment aperture 117.

Developing device 100 comprises chucking section 107 for anchoring screw cartridge 101, and coupling 102 provided at respectively different position in the circumferential direction from toner replenishment aperture 123 and starter replenishment aperture 124. The exterior surface of aperture 123 is provided with toner buffer 114 for supplying toner in predetermined amounts. Coupling 102 is connected to drive motor 105 so as to be rotatable. The exterior surface of coupling 102 is provided with holder 104 for forming a transport path 108 to supply toner and starter to developing device 109. Developing device 109 comprises transport roller 111 and mixing blades 112 for mixing and transporting toner and starter supplied via transport path 108, and developing roller 113 for developing an electrostatic latent image formed on the surface of photosensitive member 110.

Figure 5:
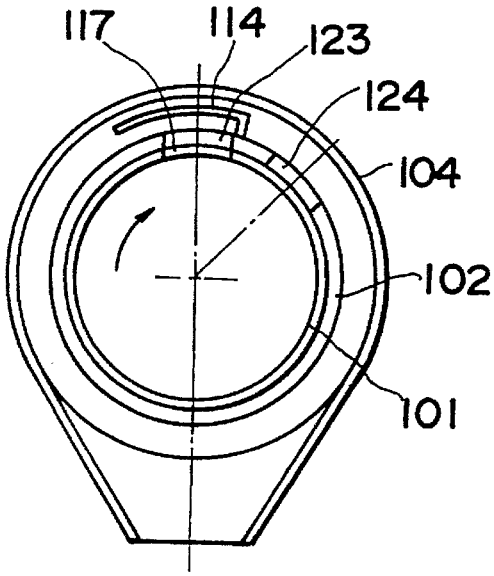
FIG. 5 is a section view on the A—A perspective of the developing device shown in FIG. 4.

Toner transport is described hereinafter with reference to FIG. 5. FIG. 5 is a section view in the A—A perspective of developing device 100 shown in FIG. 4. Aperture 117 provided on screw cartridge 101 is an aperture for supplying toner, and is disposed at a position corresponding with aperture 123 provided on coupling 102. Screw cartridge 101 is fixedly attached to coupling 102 via the aforesaid chucking section 107, and is rotatably driven in the arrow direction via drive motor 105 together with said coupling 102. Toner accommodated in screw cartridge 101 is transported in a rightward direction in the drawing in conjunction with the rotation of screw cartridge 101, and collects in toner buffer 114 after passing through apertures 117 and 123. When screw cartridge 101 is rotated, toner buffer 114 is also rotated, such that toner collected in toner buffer 114 supplies toner to developing device 109 through replenishment path 108.

Figure 6:
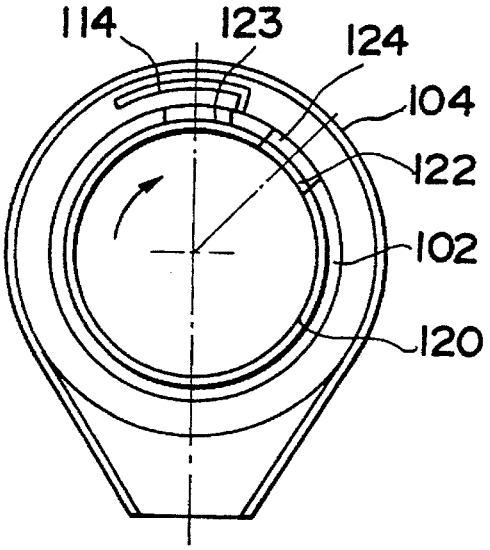
FIG. 6 is a section view on the A—A perspective of the developing device shown in FIG. 4.
Figure 8:
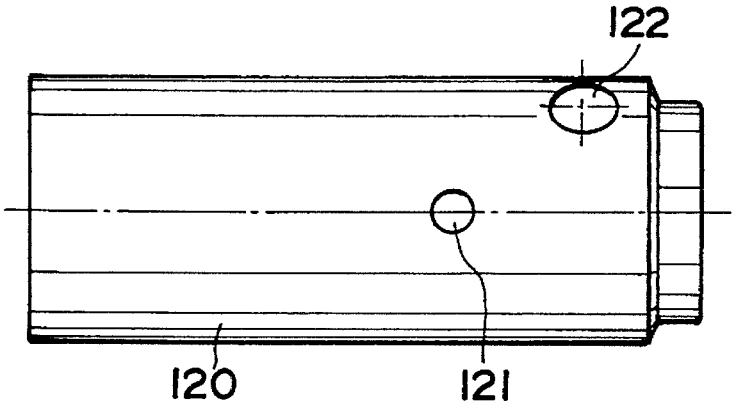
FIG. 8 is a side view showing the screw cartridge used in the second embodiment.

Starter transport is described hereinafter with reference to FIG. 6. FIG. 6 is a section view in the A—A perspective, and shows the state wherein screw cartridge 120 accommodating starter shown in FIG. 8 is installed in coupling 102 instead of the previously mentioned screw cartridge 101 of FIG. 4. Aperture 122 provided on screw cartridge 120 is an aperture for supplying starter, and is disposed at a position corresponding to aperture 124 provided on coupling 102. Screw cartridge 120 is rotatably driven in the arrow direction in the same manner as the previously described screw cartridge 101. Starter accommodated in screw cartridge 120 is directly supplied to replenishment path 108 through apertures 122 and 124 in conjunction with the rotation of screw cartridge 120, and is supplied to developing device 109.

Although screw cartridges were used as the cartridges in the first and second embodiments of the invention, it is to be understood that cartridges of a type provided with a screw-like transport member in said cartridge may alternatively be used instead of a screw cartridge. And if the cartridge is of a type wherein developer is transportable within the cartridge, other types of cartridge such as a cartridge disclosed in U.S. Pat. No. 4,615,364 may also be used.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A developing device into which is detachably installable a first cartridge accommodating toner or a second cartridge accommodating starter incorporating at least carrier, the developing device comprising:

a developing section which develops an electrostatic latent image formed on a photosensitive member;

toner buffer which supplies toner therethrough from the first cartridge to said developing section by predetermined amounts when the first cartridge is attached to the developing device; and a replenishment path which is provided separately from said toner buffer and supplies developer therethrough from the second cartridge directly to said developing section, when the second cartridge is attached to the developing device.

2. The developing device as claimed in claim 1 further comprising a coupling which holds the first or second cartridge, each said first and second cartridge having a replenishment aperture at one end and said coupling having on its peripheral surface a first aperture which corresponds to the replenishment aperture of the first cartridge when the first cartridge is attached to the coupling as well as a second aperture which corresponds to the replenishment aperture of the second cartridge when the second cartridge is attached to the coupling.

3. The developing device as claimed in claim 2, wherein said first and second cartridges are cylindrically shaped and have a spiral groove on their inner surface, and the replenishment apertures of said first and second cartridges are provided at the end of the respective spiral groove.

4. The developing device as claimed in claim 3, wherein said coupling is connected with a motor so as to be rotated with the cartridge attached thereto.

5. The developing device as claimed in claim 4, wherein said first and second apertures are provided on the coupling at different positions from each other in a direction of a rotational axis of the coupling.

6. The developing device as claimed in claim 4, wherein said first and second apertures are provided on the coupling at different positions from each other in a circumferential direction of the coupling.

7. The developing device as claimed in claim 6, wherein said toner buffer is provided in the vicinity of said first aperture on said coupling.

8. The developing device as claimed in claim 2, wherein said coupling has a chucking member and each said first and second cartridge has a protrusion on its peripheral surface which engages the chucking member.

9. A developing device comprising:

a developing section which develops an electrostatic latent image formed on a photosensitive member;

a coupling into which is detachably installable a first cartridge accommodating toner or a second cartridge accommodating starter incorporating at least carrier, each said first and second cartridge having a replenishment aperture, and the coupling having on its peripheral surface a first aperture which corresponds to the replenishment aperture of the first cartridge as well as a second aperture which corresponds to the replenishment aperture of the second cartridge;

toner buffer provided between said developing section and said coupling and supplying toner from the first cartridge through the first aperture to said developing section in predetermined amounts when the first cartridge is attached to the coupling; and a replenishment path provided between said developing section and said coupling separately from said toner buffer, and supplying starter from the second cartridge directly to said developing section through the second aperture when the second cartridge is attached to the coupling.

10. The developing device as claimed in claim 9, wherein said first and second cartridges are cylindrically shaped and have a spiral groove on their inner surface, and said replenishment apertures of said first and second cartridges are provided at the end of the spiral groove of the respective cartridges.

11. The developing device as claimed in claim 9, wherein said coupling has a chucking member and each said first and second cartridge has a protrusion on its peripheral surface which engages the chucking member.

12. A developing device comprising:

a developing section which develops an electrostatic latent image formed on a photosensitive member;

a coupling into which is detachably installable a first cartridge accommodating toner or a second cartridge accommodating starter incorporating at least carrier, each said first and second cartridge having an replenishment aperture and the coupling having on its peripheral surface a first aperture which corresponds to the replenishment aperture of the first cartridge when the first cartridge is attached to said coupling and a second aperture which corresponds to the replenishment aperture of the second cartridge when the second cartridge is attached to said coupling;

toner buffer provided in the vicinity of said first aperture on said coupling, and supplying toner from the first cartridge in predetermined amounts when the first cartridge is attached to the developing device; and a replenishment path provided between said developing section and said coupling, and supplying therethrough the predetermined amount of toner buffered by said toner buffer to said developing section when the first cartridge is attached to the coupling as well as starter from the second cartridge to said developing section when the second cartridge is attached to the coupling.

13. The developing device as claimed in claim 12, wherein said coupling has a chucking member and each said first and second cartridge has a protrusion on its peripheral surface which engages the chucking member.

14. A developing device comprising:

a developing section which develops an electrostatic latent image formed on a photosensitive member;

a holder into which is detachably installable a first cartridge including developer and having a replenishment aperture or a second cartridge including developer and having a replenishment aperture at a different position from the aperture of the first cartridge;

a first path which supplies developer therethrough from the aperture of the first cartridge to the developing section; and a second path which supplies developer therethrough from the aperture of the second cartridge to the developing section.

15. A developing device comprising:

a developing section which develops an electrostatic latent image formed on a photosensitive member;

a holder into which is detachably installable a developer cartridge and has a first replenishment aperture and a second replenishment aperture;

a first path which connects the first replenishment aperture and the developing device for supplying toner therethrough; and a second path which connects the second replenishment aperture and the developing device for supplying toner therethrough.

* * * * *